US006775874B2

(12) United States Patent
Horton

(10) Patent No.: US 6,775,874 B2
(45) Date of Patent: Aug. 17, 2004

(54) EXPANDABLE CLEANING BRUSH

(76) Inventor: Rodney Horton, 7 Edna Rd., Dorchester, MA (US) 02124

( * ) Notice: Subject to any disclaimer, the term of this patent is extended or adjusted under 35 U.S.C. 154(b) by 170 days.

(21) Appl. No.: 09/962,523

(22) Filed: Sep. 25, 2001

(65) Prior Publication Data

US 2003/0056809 A1 Mar. 27, 2003

(51) Int. Cl.[7] ..... A46L 17/00
(52) U.S. Cl. ..... 15/165; 15/164; 15/211; 15/212
(58) Field of Search ..... 15/144, 165, 211, 15/212, 213, 203, 164

(56) References Cited

U.S. PATENT DOCUMENTS 444,710 A * 1/1891 McPherson ..... 15/26
614,305 A * 11/1898 Jones ..... 15/165
1,186,400 A * 6/1916 Horodyski ..... 15/165
1,307,530 A * 6/1919 Wolf ..... 15/203
1,827,569 A * 10/1931 Edgar ..... 15/165
2,037,870 A * 4/1936 Whisler et al. ..... 15/65
2,432,924 A * 12/1947 Nishizaka et al. ..... 15/212

FOREIGN PATENT DOCUMENTS

DE 723221 * 7/1942 ..... 15/203

* cited by examiner

*Primary Examiner*—Robert J. Warden, Sr.
*Assistant Examiner*—Shay L Balsis
(74) *Attorney, Agent, or Firm*—Davis & Bujold, PLLC

(57) ABSTRACT

A cleaning and scouring brush generally made from a pair of twisted wire arms, each arm having a cleaning portion shaped to conform to the interior profile of an article to be cleaned. The portions are provided with a cleaning or scouring device such as a sponge, scrubber or bristles intended to clean or scour the interior surface of the article to be cleaned. The brush is also provided with a handle which rotates the cleaning portions with respect to one another about an axis in order to facilitate the entry and removal of the device from the article to be cleaned which generally has a relatively small opening into a relatively large interior volume.

12 Claims, 6 Drawing Sheets

Fig. 3D
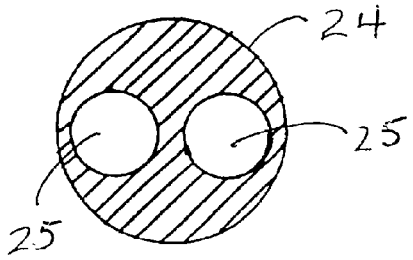
Fig. 3C
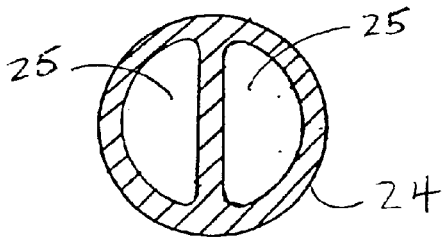
Fig. 3B
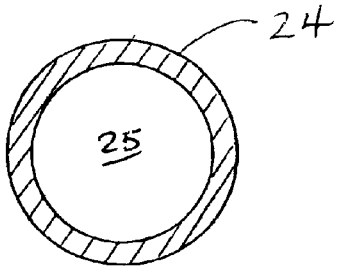
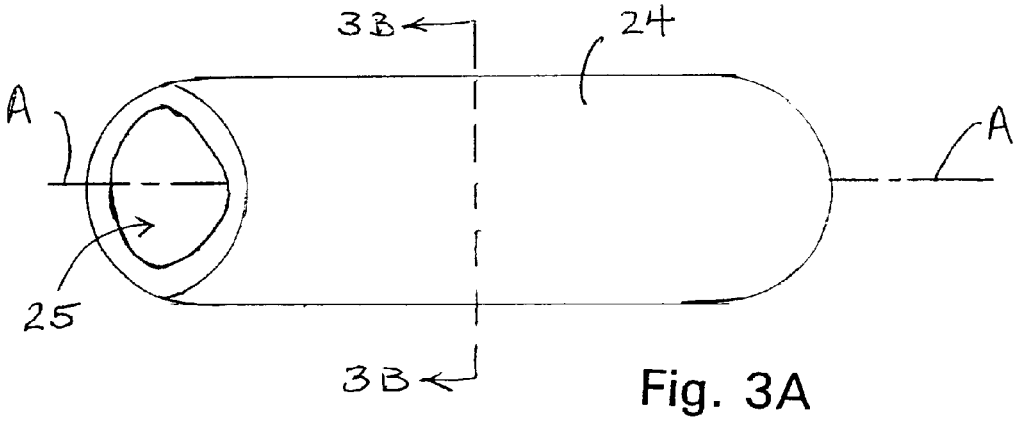
Fig. 3A

EXPANDABLE CLEANING BRUSH

FIELD OF THE INVENTION

The invention relates generally to a utility cleaning brush suitable for scrubbing and cleaning the various interior surfaces of a container and, more particularly to a hand held cleaning brush having a folding brush portion operated by handles which are capable of manipulating the folding brush portion to the extent necessary to facilitate the insertion and operation of the brush within the interior volume of a substantially closed container for instance a coffee pot or decantor having an opening or access which is substantially smaller than the containers interior volume as well as an expanded position of the folding brush portion of the cleaning brush.

OBJECT AND SUMMARY OF THE INVENTION

It is an object of the present invention to provide an improved cleaning apparatus, for articles such as coffee pots, bottles and tea kettles and the like which have large interior volumes and small access ports or openings which makes it difficult to access such articles for cleaning.

Another object of the present invention is to lower the cost and increase manufacturing efficiencies by utilizing easily obtainable materials to construct the brush.

A still further object of the invention is to provide a brush which can be easily manipulated by a user in such a manner as to clean containers of various internal volumes which ensures that the varied surfaces within the container are efficiently and sufficiently cleaned.

A yet still further object of the invention is to provide a brush which conforms to the interior dimensions of the container being cleaned to ensure cleaning and contact of the brush over the various interior surface(s) of the container.

A further object of the invention is to provide an expandable cleaning apparatus that can generate substantial force for scrubbing against the wall of the container when it is positioned within the container, yet can easily pass through the neck of the container for insertion and removal.

BRIEF DESCRIPTION OF THE DRAWINGS

FIG. 3A is a perspective view of the collar;

FIG. 3B is a cross-sectional end view of the collar;

FIG. 3C is a cross-sectional end view of a second embodiment of the collar;

FIG. 3D is a cross-sectional end view of a third embodiment of the collar;

DETAILED DESCRIPTION OF THE PREFERRED EMBODIMENTS

Figure 1:
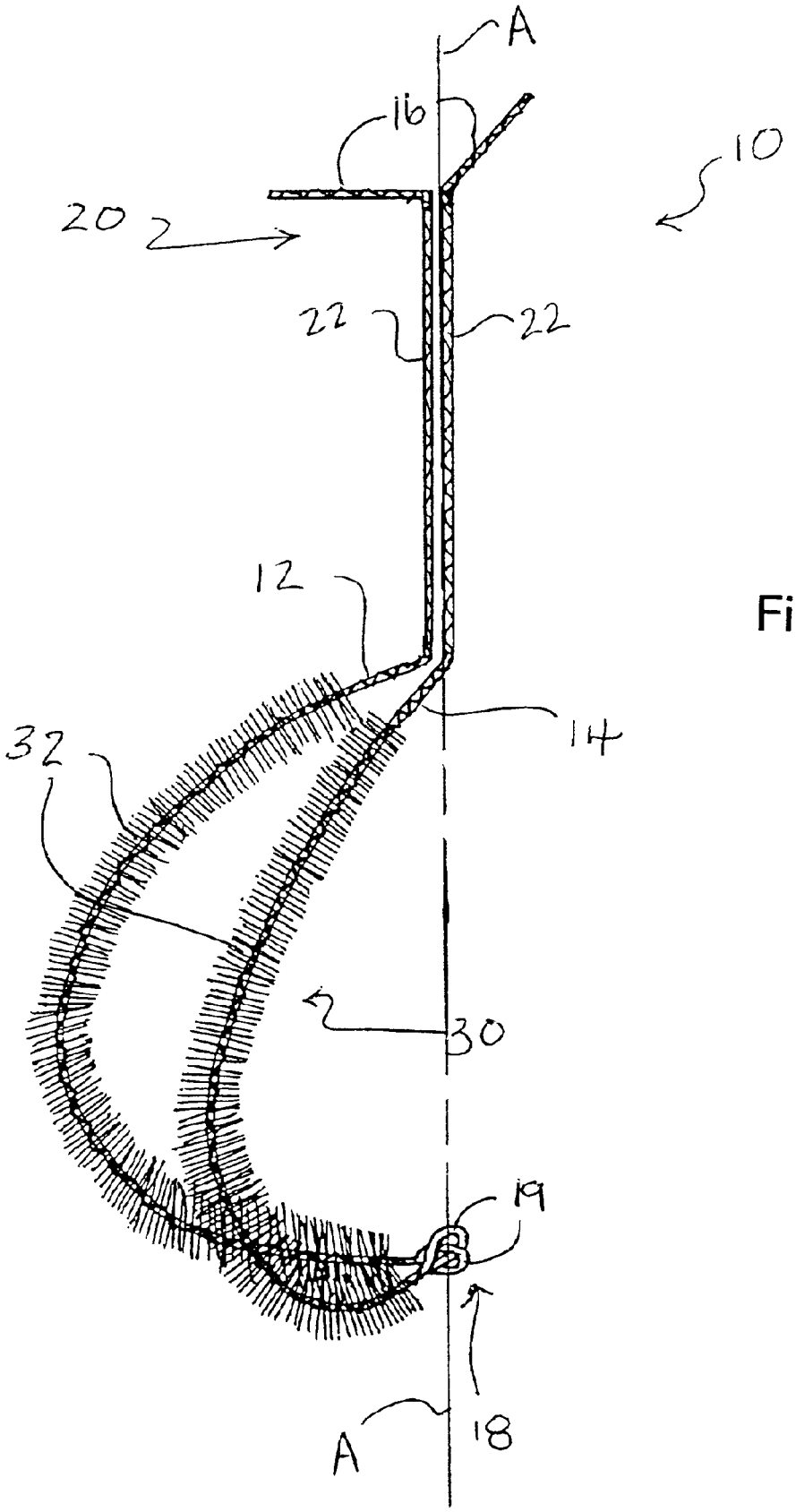
FIG. 1 is a perspective view of the arms of the brush of the present invention in a semi-open position.
Figure 2:
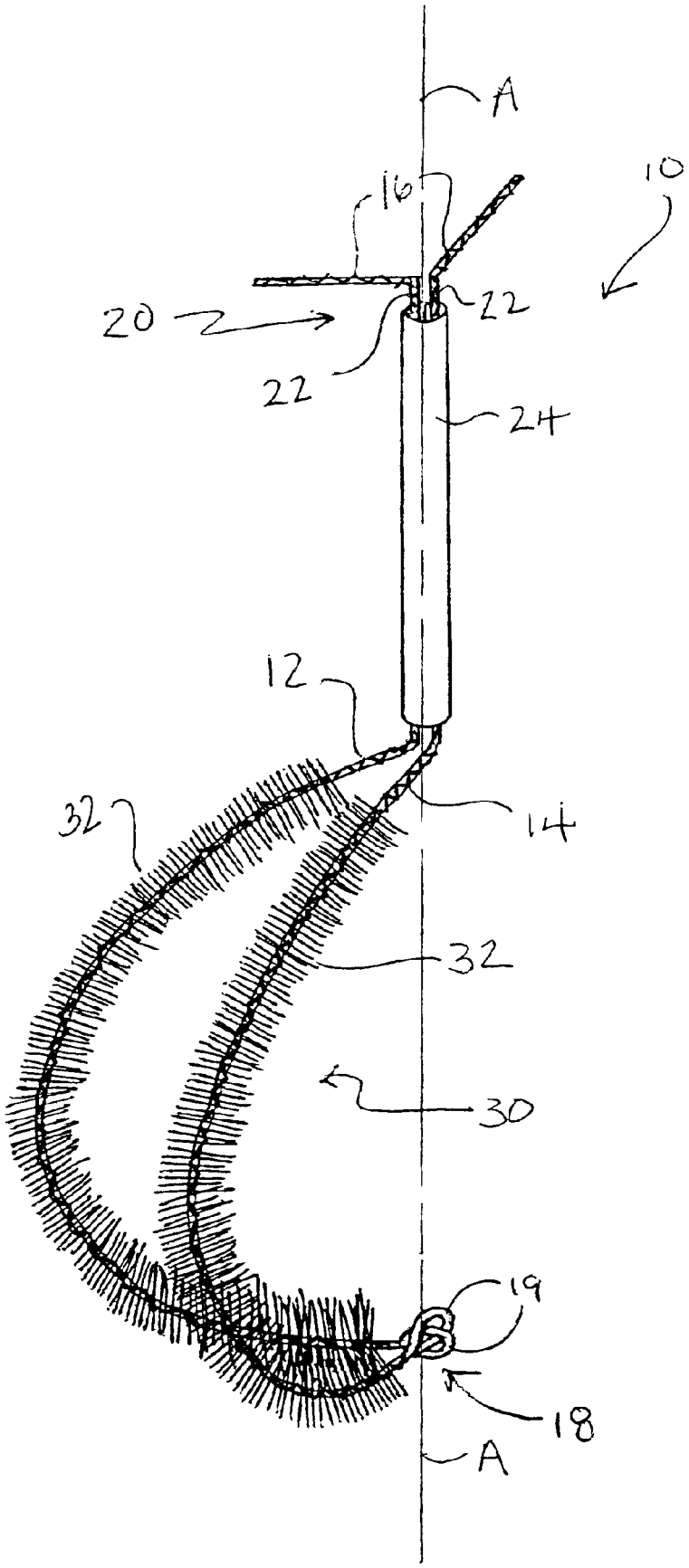
FIG. 2 is a perspective view of the arms of the brush having a surrounding collar in a semi-open position.

Referring now to the drawings, wherein like reference numerals designate corresponding structure throughout the views, and referring in particular to FIGS. 1 and 2, a cleaning brush device 10 for cleaning interior surfaces of a container or the like, for instance, a container such as a coffee pot, a bottle or a tea kettle, is shown and generally described.

The cleaning brush device 10 is structurally composed of a first and second hingedly connected arms 12, 14, rotatable with respect to one another into an open cleaning position and on the other hand into a closed container insertion position about an axis A. Each of the arms includes at a first end a respective operating handle 16, contiguously attached to a respective intermediate section 22, which is in turn connected to a brush portion 30 leading finally to a hinged connection 18 at each of the respective second ends of the first and second arms 12, 14. The hinged connection 18 link the respective second ends of the both the first and second arms 12, 14 together.

In view of the above description, the first ends of the hinged arms 12, 14 define a handle portion 20 connected by the intermediate sections 22 to the cleaning brush portion 30 substantially adjacent the second ends. The handle portion 20, which includes the operating handles 16, and a collar 24, through which the intermediate sections extend, is sized and configured to be gripped and manipulated by a hand and fingers of a user for control of the cleaning brush portion 30 and associated cleaning operations. The cleaning brush portion 30 is sized and configured to ensure contact can be made between a brush or other scouring or abrasive element 32 on the brush portion 30, and an interior surface of an article or container to be cleaned, a further description of such use and operation will be provided in detail below.

The handle portion 20 of the first and second hinged arms 12, 14 include the respective intermediate sections 22 encompassed by the collar 24 for essentially holding the first and second hinged arms 12, 14 in relative rotatable proximity at the respective handle portions 20. The collar 24 defines a bore 25 oriented about the longitudinal axis A, through which the intermediate sections 22 of the hinged arms 12, 14 run substantially parallel to the axis A.

Upon appropriate manipulation by the user, the arms 12, 14 are in general designed to turn in opposite directions, e.g. the first arm 14 may turn clockwise and the second arm 16 turns respectively counter clockwise about the axis A. The operating handles 16 extend from a first end of the collar 24. The operating handles 16 may extend several inches outwardly from the first end of the collar 24 and can be oriented in a perpendicular manner relative to the longitudinal axis A to provide appropriate torque to the arms 12, 14 to cause the above described relative rotation.

The brush portion 30 is intended to substantially match the interior profile of an article to be cleaned. A container, in general, has an interior surface which may be of any shape or profile depending on the shape of the container. The brush portion 30 is bent or formed so as to bring the main cleaning element 32 into substantial contact with at least a substantial portion of the entire interior profile of the container. For example, in a container having a continuously consistent profile such as a coffee pot or coffee urn as is known in the art, each of the first and second arms 12, 14 are provided with the brush portion conforming to approximately one half the profile of the coffee pot. The other of the first or second arms 12, 14 is provided with a brush conforming to the remaining substantially half profile of the coffee pot or urn. Thus, when in the open position and the brush portions and the main cleaning elements 32 are thus expanded and opposed to one another, substantially the entire interior profile of the container is in contact with the main cleaning elements 32. Thus is easily understood when an operator rotates the handle 16, the cleaning brush portion 30 can scour the entire 360° of the interior surface of the container without adjustment. A further description of the use and function of the brush is provided below.

It is to be appreciated that each of the first and second arms 12, 14 define first and second planes rotating about the axis A. In the closed position, the cleaning elements 32 are adjacent one another and the planes defined by the arms 12, 14 are also substantially adjacent and spaced parallel with one another. Upon rotation of the handle 16, the cleaning elements 32 are rotated away from one another and thus the first and second planes are rotated through an angle of 0 degrees to 180 degrees into an opposed position, essentially a mirrored image of one another wherein the cleaning elements 32 are substantially separated by 180 degrees and the respect of first and second planes are co-planarly aligned with one another.

The brush portion 30 includes the main cleaning elements 32, substantially positioned between the collar 14 and the hinged ends 18 on each of the first and second arms 12, 14. The main cleaning element 32 may be a brush, scrubber, sponge, scouring device or some abrasive or semi-abrasive material for cleaning the desired surface(s). As will be apparent to any one of skill in the art, any number of cleaning devices could be attached to each arm dependent upon the scouring difficulty of the container being cleaned. In addition, a replaceable cleaning element could be provided on the brush portion 30, to ensure that the device is reusable despite the cleaning element wearing out or the necessity for more or less scouring of the surfaces being cleaned. A further detail description of the above generally described brush portion 30 and cleaning element 32 is provided below.

Figure 5:
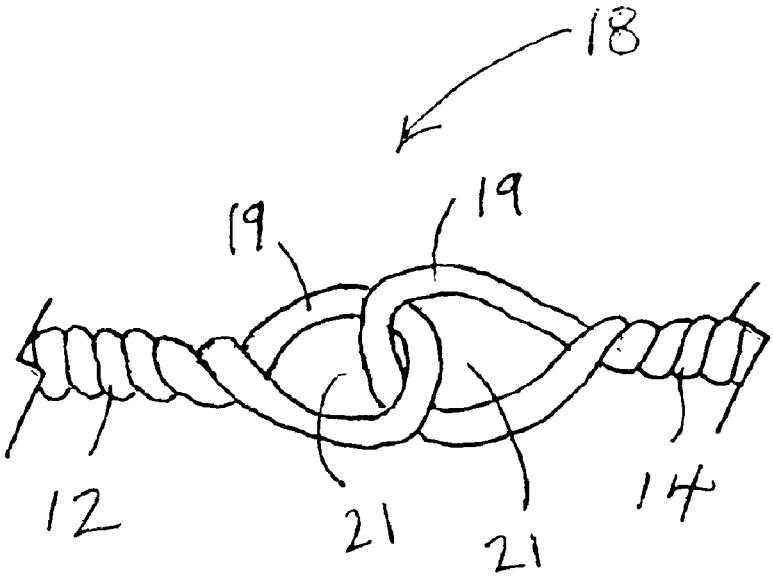
FIG. 5 is a side view of the interconnection between the arms of the brush.

The hinge connection 18 may be of any type known in the art, in the present embodiment a wire loop 19 is provided at each of the second opposing ends of the arms 12, 14 and the loops 19 are interconnected as seen in FIG. 5 to provide the hinged connection 18, a further description of these elements are provided below. It is to be realized that a hinge of any type, such as a pin inserted into holes in the second ends of the arms 12, 14, would also provide the appropriate interconnection between the arms 12, 14 and that any number of hinge connections as known in the art could be substituted in place of the above described loops 19.

Turning now to FIGS. 3A–D, the collar 24 is described in further detail. The collar 24 is a tubular element defined about the longitudinal axis A. The collar 24, rotatably supports and encompasses the intermediate sections 22 of handle portions 20 in rotatable proximity. The collar 24 may also act as a support for the users hand and in conjunction with the operating handles 16 to assist in operating the device 10 during opening, closing and cleaning operations. The collar 24 has at least a single bore 25 extending along the length of the collar 14 parallel to the longitudinal axis A. The bore 25, which encompasses the intermediate portion of the arms 12, 14, may be constructed as a single bore or as shown in FIGS. 3C–D may be formed as a pair of bores so as to physically separate each intermediate section 22 of the arms 12, 14 from one another.

Figure 4:
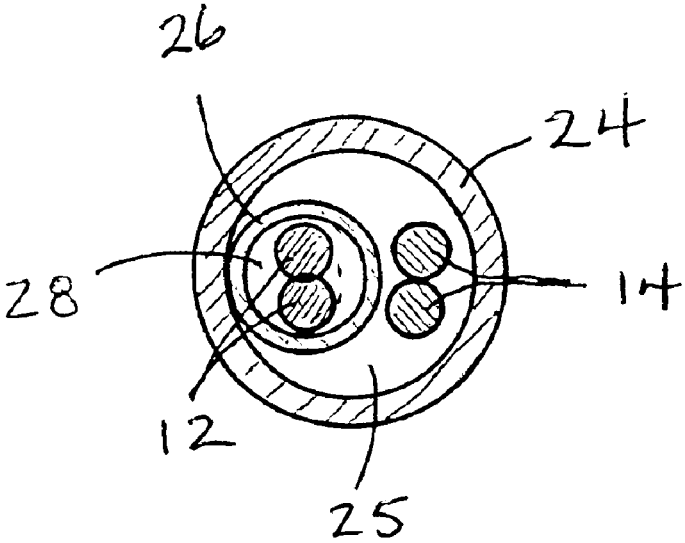
FIG. 4. is a cross-sectional view of the collar and arms extending therethrough.

The physical separation of each arm 12, 14 by the pair of bores 25, may be necessary to ensure that the arms 12, 14 do not become entangled or intertwined with one another so as to cause the apparatus to mechanically lock up or to over rotate. As shown in FIG. 4, and described in further detail below, a sheath 26 defining a second bore 28 may also be provided surrounding one of the first or second arms 12, 14 to separate the arms, for the above noted reason as well as to decrease the frictional resistance between the intermediate portions of the arms within the collar 24.

Referring now to FIGS. 1–5, in a preferred embodiment of the present invention, the arms 12, 14 are constructed as a first and second twisted wire brushes held together adjacent about the intermediate section 22 via the collar 24, and connected at the respective second ends via the loops 19 forming the hinged connection 18. Each twisted wire arm 12, 14 is essentially a separate twist wire brush as are known in the art for cleaning bottles, tubes, pipes etc. Each individual arm 12, 14 including the handle portion 20, intermediate portion 22, the cleaning brush portion 30 and the hinged end 18 is formed initially from a contiguous length of wire, doubled over on itself and helically wound to create two tightly wound strands intertwined about one another. Each twisted wire arm 12, 14 is formed by matching the free ends of the length of wire, bending the wire essentially in half at a midpoint, and the two matching strands are then helically wound about one another to form a twisted wire arm. The midpoint at which the length of wire is bent naturally becomes the second ends of the arm at which opposing end the loop 19 forming a portion of the hinged connection 18 is formed.

In the case of the present embodiment, and as can be appreciated by one of skill in the art, each arm 12, 14 is formed from an individual length of wire. In order to form the described device 10 and the hinged connection 18 between the two arms 12, 14, two individual lengths of wire are overlapped at their midpoints, and each length is then bent essentially in half to bring the respective free ends of each of the two lengths of wire into substantially matched relation. As seen in FIG. 5, when the first and second strands of each individual length of wire are intertwined about one another, the loop 19 defining an eyelet or hole 21 is left at the opposing end of each arm 12, 14 essentially at the midpoint of each length of wire, thus interconnecting the two individual lengths of wire and forming the second hinged, and now joined, ends 18 of each arm 12, 14.

The brush portion 30 of the first and second arms may now be formed by any process as is known in the art for forming twisted lengths of wire into a form which substantially matches the interior profile of the desired container to be cleaned. Thus the brush portions when rotated by the handle 16 may be brought into close matching proximity with one another, for insertion within a container, and may also be rotated into substantially opposing position wherein they are mirror images of one another separated by approximately 180 degrees, thus mirroring the entire interior profile of a container.

It is to be appreciated that in a case where the interior profile of a container is not consistent throughout the circumference of the container. For example, in a square bottle or can, the handle may need to be adjusted throughout the cleaning operation to fully clean all the surfaces within the container. In the case of a coffee pot or urn, as is commonly known, the brush portion 30 may be conformed immediately thereto and due to the consistency of this circumferential profile, the device needs no further adjustment once the profile of the container has been substantially matched by the open position of the first and second arms 12, 14.

In the present embodiment, the brush 32 is made of hundreds of plastic bristles extending circumferentially perpendicularly out from between each strand of the twisted wire. The bristles are substantially affixed along a desired length of the twist wire by capturing the bristles between the two tightly helically wound strands during the initial intertwining process. The desired length of the brush 32 along the brush portion 30 of the arms 12, 14 which are intended to be brought into contact with the interior surface of the article being cleaned, depends upon the inner dimensions of the container. For instance as observed in FIG. 6, in the case of a coffee pot or decanter 40 having an interior profile P defining a curving surface having a length of curvature L of about 16 inches, each arm of the device must provide coverage for substantially half of the profile length, i.e. 8 inches, therefore the bristles of the brush must extend along the axial length of each of the brush portions 30 of the arms 12, 14 for approximately 8 inches. As profiles and sizes of different containers may be substantially different, it is to be appreciated that the brush 32 of the brush portion 30 may be of substantially any length to match the interior surface profile of various containers.

In the present embodiment, the cleaning element 32 is described above being approximately 8 inches of length on each individual arm 12, 14, the collar encompassing the intermediate section may have a length of from about 2 inches to 5 inches and more preferably 4 inches, and the handle 16 may be provided with a length between 2 inches and 5 inches and more preferably approximately 3 inches.

Additionally, because such twist wire brushes are malleable by their very nature, the axial brush lengths may be bent and conformed to different size and configurations of containers as needed. As such twist wire brushes and such particular features are known in the art no further discussion is provided herein.

Returning now to FIG. 4, a sheath 26 is applied over one of the first or second twisted wire arms 12, 14 so that the intermediate section 22 of one of the first or second arm is disposed within the second bore 28 of the sheath 26. The collar 24 is applied over both arms 12, 14 as well as the sheath 26 so that the arms 12, 14 are held in relative rotational alignment about their respective intermediate sections. The sheath 26 thus separates the two twisted wire sections 12, 14 and allows them to rotate freely within the bore 25 relative to one another without becoming entangled. Additionally, the collar 24 and sheath 26 frictionally maintain the relative axial positioning of the two twisted wire arms 12, 14.

The cross-section of FIG. 4 shows the alignment of the two twisted wire intermediate sections, one being within the sheath 26 and both extending through the bore 25 of the collar 24. The twisted wire arms 12, 14 and the sheath 26 are held in position by a frictional fit within the collar 24.

According to the present embodiment one particularly advantageous feature of the invention, is that the twisted wire arms 14, 16 are bendable and malleable. This feature allows the user to configure the scouring portion 24 to match the profile of the interior surface of the object to be cleaned, for instance as shown in FIGS. 6 and 7 the cleaning brush portion is bent into an elliptical configuration to match the inner profile of a conventional commercial coffee pot.

Due to the malleable nature of the twist wire arms 12, 14, the handles 16 can be bent to extend perpendicularly outwards relative to axis A from the first end of the collar 24. The brush portion 30 may also be bent to conform the brush 32 to the desired profile of a container so that the bristles will be brought into contact with the surface to be cleaned. The brush 32 as discussed above can be any type of scouring material as is known in the art. The brush 32 may be fabricated from commercially available known material that is suitable for such purposes, for example, sponge, cloth, plastic and rubber and scrubber like abrasive material which would conform to the shape into which the brush portion 30 is bent.

Located at the end of the scouring portion 24 of the twisted wire brush members 16, 20 opposite the handles 16 the connected hinged ends 18 incorporating the loops 19 incorporated in the second ends of the individual twist wire arms 12, 14 engage each other in such a manner that allows the arms 12, 14 to pivot about the axis A.

Figure 6:
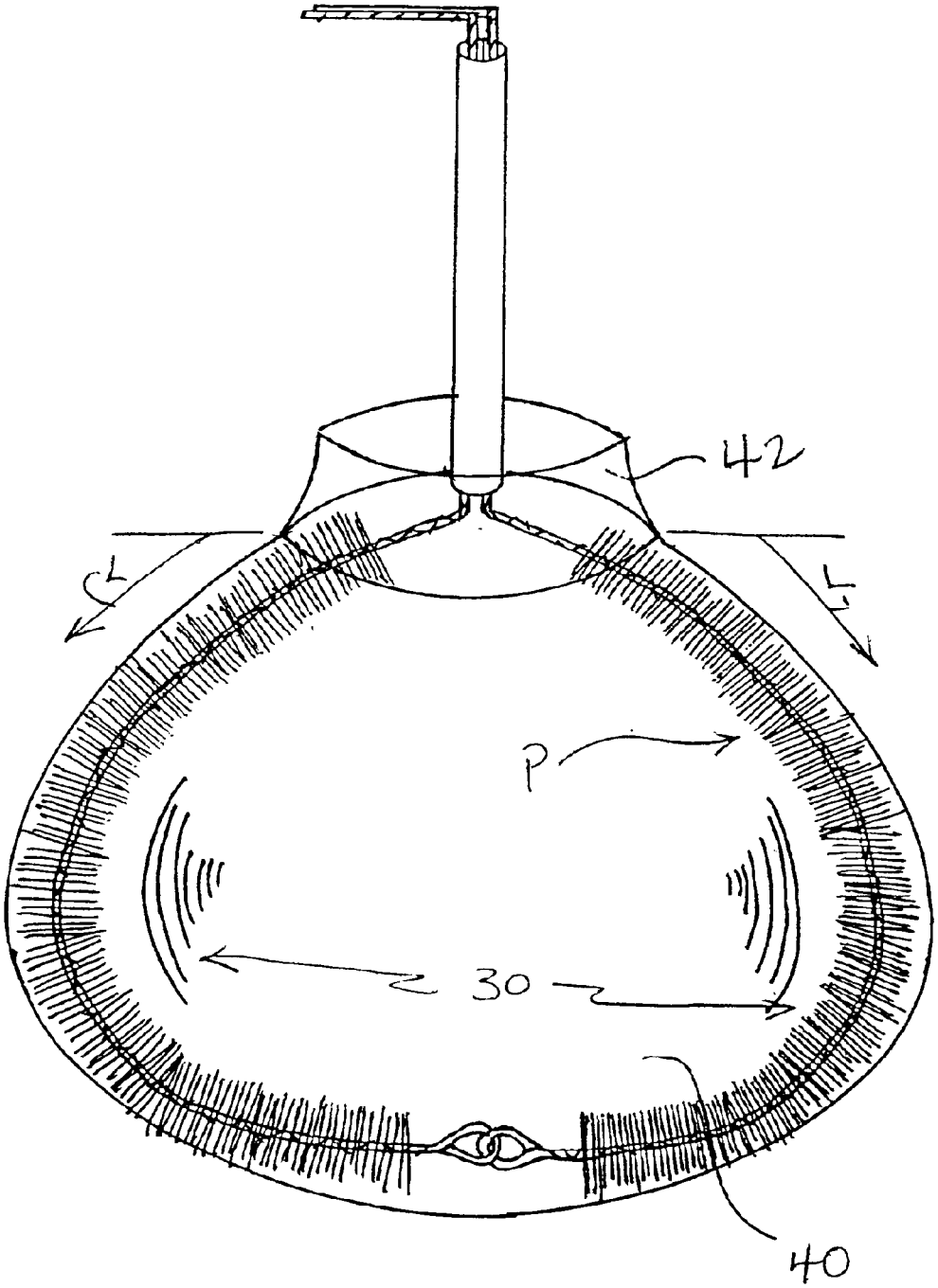
FIG. 6 is a perspective view of the brush in an open position in conjunction with an article to be cleaned.
Figure 7:
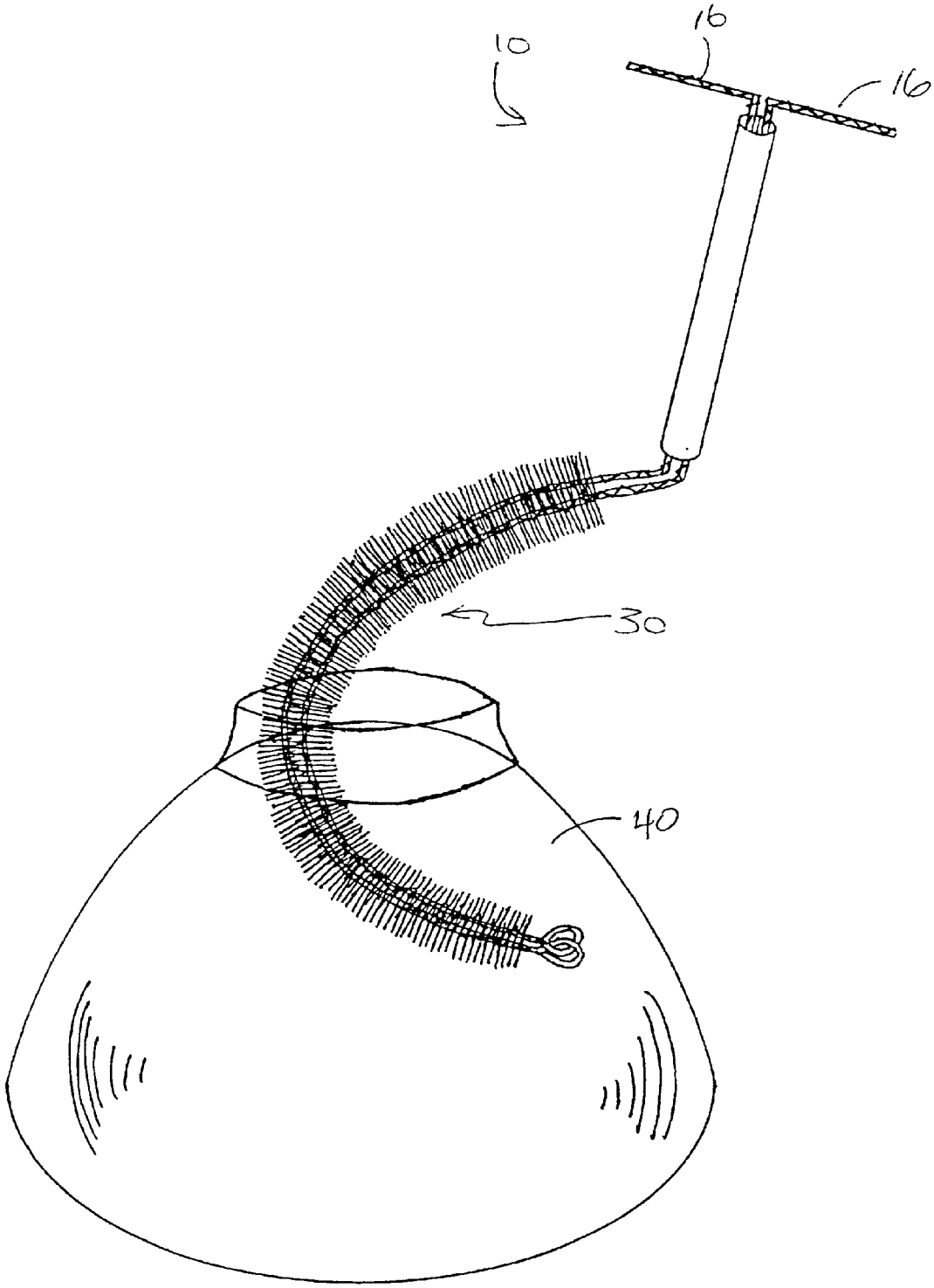
FIG. 7 is a perspective view of the brush in the closed position being inserted into the article to be cleaned.

The use of the brush along with the expandable feature as seen in FIGS. 6 and 7 will now be described. In the present embodiment, to actuate the device 10 into an open cleaning position as shown in FIG. 6, an operator rotates the handles together, thus expanding or folding arms 12, 14 outward from one another. In order to close the device 10 for insertion or removal operations, the handles 16 are rotated apart as seen in FIG. 7, thus bringing the brush portions 30 of the arms 12, 14 into close proximity to facilitate passage of the brush portion 30 through a narrow opening of a container. The pivoting motion of the arms 12, 14 and the scouring portions 24 are controlled by adjusting the handles 16 to allow for easy alteration of the spacial relationship between the individual scouring portions 24.

As seen in FIG. 7, when the operator desires to insert the brush within the container, the operating handles 16 are brought into substantially linearly adjacent alignment, i.e. the handles 16 are linearly opposed, thus closing the arms 12, 14 to also be aligned substantially side by side. This arrangement allows the brush portion 30 to be inserted into objects such as pot 40 having narrow necks 42 that would otherwise be difficult to wash.

Once inserted into the volume to be cleaned the user manipulates the handles 16 via the fingers of one hand into the position as seen in FIG. 6 wherein the brush portions 36 of the arms 12, 13 are separated by approximately 180 degrees. The handles 16 are rotated so as to be substantially adjacent to one another, by rotating the handles 16 also approximately 180 degrees into a side by side relation relative to one another and the opening of the brush portions is accomplished.

It is also to be appreciated that the handle 16 may be manipulated so that the brush portions of the arms 12, 14 may be separated by any angle between 0° and 180° to accommodate various smaller or differently profiled containers than by those presently described. It should also be noted that the handles 16 and the collar 24 could be covered with any type of non-slip coating covering or rubber protective film, such as known in the art, due to the necessity of the cleaning device being utilized in a cleaning type situation which would enable a user to utilize one hand to manipulate the brush with one hand while holding the article with another as in any desired container washing operation.

With both handles 16 substantially adjacent as seen in FIG. 6, the scouring brushes 32 are in the open position and the brush is ready to be used. Now in the open position, the user, while grasping the handle portion 20 and maintaining the brush portions 30 in the open position, spins the entire brush 10 throughout at least a 180 degrees rotation while applying pressure as needed to contact and clean the entire interior surface of the container or pot with the bristles of the brushes 32.

To disengage the apparatus 10 from the cleaned object, the user simply rotates the handles 16 from the adjacent open position into the opposed position to facilitate removal of the brush in reverse to the steps as outlined above.

Modifications may be made in the invention without departing from the spirit of it. For example, it would be within the scope of the invention to have more than two twisted wire brush members wherein the brush members when in an open position could define the interior surface of the object to be cleaned.

It would also be within the scope of the invention to change the handles 16 of the arms such that alignment of the handles could be changed in relation to the scouring portions. The adjuster portions could also consist of knobs or dials instead of extensions of the brush members. These various elements would perform the same tasks in a similar manner.

What I claim is:

1. An expandable cleaning device for facilitating the insertion and removal of the cleaning device through a container opening substantially smaller than the interior profile of the container to be cleaned, the cleaning device comprising:

at least a first and second arm members each having a contiguous handle portion and brush portion rotatably connected together about a hinge axis;

a cleaning element supported by the brush portion of each said first and second arm wherein the cleaning element and the brush portion of each said first and second arms define a profile shaped brush portion patterned to coincide with at least a portion of a profile of the container to be cleaned;

a first position wherein the first and second arms are rotated radially about the hinge axis relative to one another so the profile shaped brush portions are matchingly adjacent one another, and a second position wherein the first and second arms are radially rotated about the hinge axis so that the profile shaped brush portions are opposedly separated from one another; and wherein the hinge axis is defined by a collar encompassing an intermediate portion between the handle section and the brush sections of both said first and second arms.

2. The expandable cleaning device as set forth in claim 1 wherein the intermediate sections of one of said first and second arm are physically separated from one another within the collar by a divider.

3. The expandable cleaning device as set forth in claim 2 wherein the first and second arms are rotatably connected to one another at a second end by a lower hinge.

4. The expandable cleaning device as set forth in claim 3, wherein the first and second arm members are twisted lengths of wire connected together to form the lower hinge at the respective second ends by mutual connecting first and second wire loops.

5. The expandable cleaning device of claim 1, wherein the cleaning element supported on each said first and second arm is at least one of a bristle brush, a scouring pad, and a sponge.

6. The expandable cleaning brush of claim 5, wherein the brush sections and respective cleaning elements are malleable and able to adjustably conform to various profiles of different containers.

7. The expandable cleaning device as set forth in claim 1, wherein the shaped profile of each said brush sections defines a respective first and second plane and in said first position said first and second planes are adjacent and substantially parallel spaced from one another and that in the second position said first and second planes are co-planarly aligned.

8. The expandable cleaning device as set forth in claim 7, further comprising an intermediate position wherein the first and second arms are rotated about the hinge axis relative to one another so that the respective first and second planes are angularly aligned between about 0 and 180 degrees.

9. A cleaning brush for cleaning and scouring the inside interior surface of a container, the cleaning brush comprising:

a first arm;

a second arm, the first and second arms being rotatably hinged with respect to one another about an axis A;

each said first and second arm having a handle portion and an axially fixed brush portion, the handle portion of each said first and second arm being circumferentially movable with respect to one another to provide relative circumferential rotation between the brush portions of the first and second arms about the axis A;

wherein the first and second arms are provided with a first position wherein the arms are radially rotated into a substantially adjacent position whereby the cleaning brush may be inserted through a relatively small opening in a container, and a second position wherein the handle portions rotate the brush portions at a fixed radius about the axis A and relative to one another so that they are separated by a desired angle and substantially contact the entire profile curvature of the interior surface of a container; and wherein the handle portions are further connected by a collar having a bore for rotatably maintaining the first and second arms in relative rotational proximity with one another.

10. The cleaning brush as set forth in claim 9, further comprising the first and second arms having a second end spaced from the first end, the second end comprising a portion of a hinged connection connecting the respective second ends of the first and second arms with one another, the hinge defining an axis with the axis A defined by the bore of the collar.

11. The cleaning brush as set forth in claim 10, further comprising a brush portion of the brush comprising an abrasive or semi-abrasive material for contacting the interior surface of a container for cleaning, the brush being directly supported on the arm which at least along the portion of the arm supporting the brush may be bendably adjusted to match the interior profile of various differently shaped containers.

12. The cleaning brush as set forth in claim 11, further comprising wherein each of the first and second arm is composed of a single length of helically wound wire comprising a first and second strand wound about one another the twisted wire strand being maleable or bendable to conform to the interior profile of various differently shaped containers.

* * * * *